United States Patent [19]

Lasley

[11] 4,432,354

[45] * Feb. 21, 1984

[54] HYPERBARIC OXYGEN CHAMBER WITH FLUIDIC CONTROL

[76] Inventor: Robert A. Lasley, 11 Wardell Ave., Rumson, N.J. 01760

[ * ] Notice: The portion of the term of this patent subsequent to Oct. 27, 1998 has been disclaimed.

[21] Appl. No.: 249,482

[22] Filed: Mar. 31, 1981

Related U.S. Application Data

[63] Continuation of Ser. No. 42,114, May 24, 1979, Pat. No. 4,296,743.

[51] Int. Cl.[3] ..... A61H 31/02

[52] U.S. Cl. ..... 128/30; 128/40

[58] Field of Search ..... 128/28, 30, 30.2, 205.26, 128/297, 298, 299, 1 B, 204, 38, 40, 41, 184; 137/625.66

[56] References Cited

U.S. PATENT DOCUMENTS

| | | | |
|---|---|---|---|
| 2,168,611 | 8/1939 | Thompson | 128/299 |
| 2,235,138 | 3/1941 | Billetter | 128/38 |
| 3,478,769 | 11/1969 | Zavod et al. | 128/205.26 |
| 3,547,118 | 12/1970 | Kolman | 128/205.26 |
| 3,566,862 | 3/1971 | Schuh | 128/30.2 |
| 3,996,965 | 12/1976 | Peters | 137/625.66 |
| 4,003,371 | 1/1976 | Fischer | 128/30.2 |
| 4,121,571 | 10/1978 | Pickering | 128/1 B |
| 4,161,172 | 7/1979 | Pickering | 128/1 B |
| 4,236,513 | 12/1980 | LoPiano | 128/40 |
| 4,296,743 | 10/1981 | Lasley | 128/1 B |

FOREIGN PATENT DOCUMENTS 1329241 9/1973 United Kingdom ..... 128/299

OTHER PUBLICATIONS

"Some Examples of Fluidics Applications in the Medical Field" Darowski et al., Engineering in Medicine, vol. 5, No. 1, pp. 13–18, Jan. 1976, Institution of Mechanical Engineers, London, England.

*Primary Examiner*—C. Fred Rosenbaum
*Assistant Examiner*—J. L. Kruter
*Attorney, Agent, or Firm*—Witherspoon & Hargest

[57] ABSTRACT

A portable chamber for enclosing a portion of the body for treatment with oxygen or other gas at pressures slightly above atmospheric and the control circuits for operating the chamber are disclosed. In its basic configuration, the chamber of the invention is designed to enclose a portion of the body, such as a leg or arm, but can be enlarged to enclose the entire body, except the head of the patient. In its basic design, the chamber of this invention is constructed in two parts that mate to form the chamber. When mated, one end of the chamber is closed and the other end is open to receive the part of the body being treated. The open end contains a sleeve that encircles the body part being treated to form an air tight seal. A gasket arrangement is provided to seal the two parts when mated. The control circuits or elements are fluidic elements. These fluidic elements are housed in a control box and coupled to the chamber by means of appropriate couplers mounted on the closed end of the chamber. A humidifier is also attached to the closed end of the chamber on the outside of the chamber.

3 Claims, 7 Drawing Figures

FIG. 2
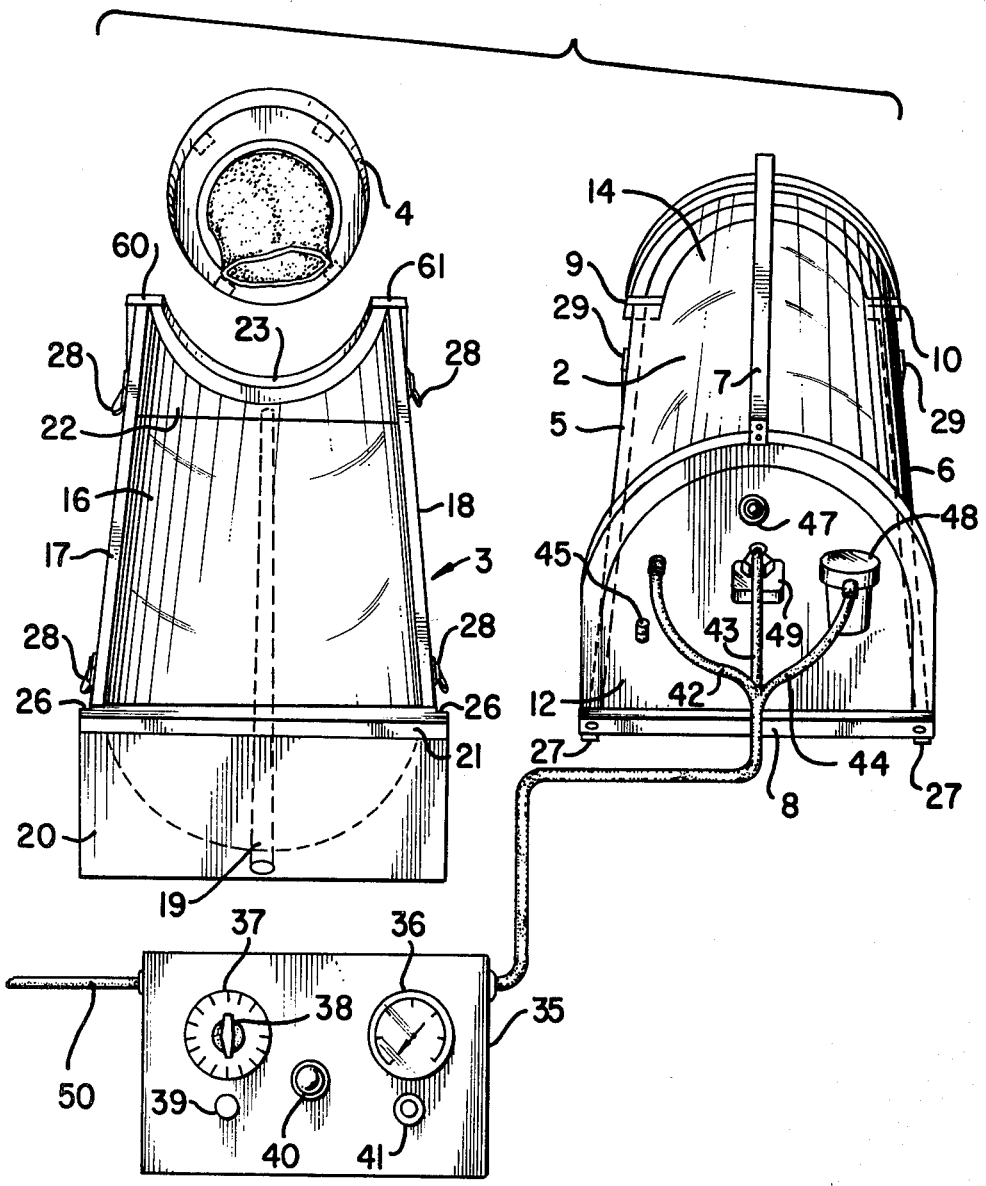
FIG.5A
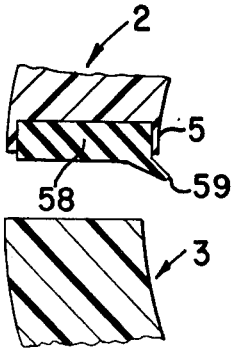
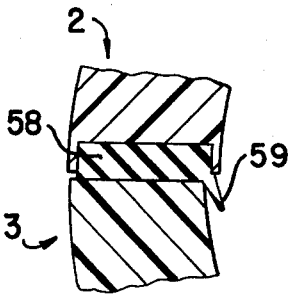
FIG.5B

HYPERBARIC OXYGEN CHAMBER WITH FLUIDIC CONTROL

This application is a continuation of application Ser. No. 042,114 filed May 24, 1979, now U.S. Pat. No. 4,296,743.

BACKGROUND OF THE INVENTION

This invention relates to hyperbaric chambers and more particularly to an improved hyperbaric chamber having fluidic control means. Therapeutic chambers for treatment of certain disease are known in the art. Examples of such chambers are disclosed in the following United States Patents:

U.S. Pat. No. 1,071,103 to Sims,
U.S. Pat. No. 2,098,272 to Benson,
U.S. Pat. No. 2,113,253 to Gray,
U.S. Pat. No. 2,134,646 to Sauzedde,
U.S. Pat. No. 2,142,689 to Emerson,
U.S. Pat. No. 3,094,116 to Logan et al,
U.S. Pat. No. 3,961,625 to Dillon,
U.S. Pat. No. 3,599,631 to Werding,
U.S. Pat. No. 3,744,491 to Fischer,
U.S. Pat. No. 4,003,371 to Fischer.

This invention relates to hyperbaric chambers of the type disclosed in the aforementioned patents to Fischer and particularly to the type of chamber disclosed in the Fischer U.S. Pat. No. 4,003,371. However, the chambers of this invention represent an improvement in construction design and control circuitry. In the prior art chambers such as the chamber disclosed in said Fischer U.S. Pat. No. 4,003,371, the control apparatus utilized to apply oxygen to the chamber requires a source of electricity. In the chamber apparatus of this invention, the control elements are all fluidic elements and no source of electricity is required.

In addition, the structural design of the chamber of this invention provides certain advantages not provided by the prior art chambers, such as the chamber disclosed in U.S. Pat. No. 4,003,371. For example, in such prior art chambers the top and bottom parts are specifically designed to mate with each other such that the top part of one chamber is not interchangeable with the bottom part of another chamber and vice versa. The top and bottom parts of the chambers of this invention are later changeable.

SUMMARY OF THE INVENTION

This invention relates to hyperbaric chambers and the control circuitry or elements for operating such chambers. In accordance with this invention the control circuitry or elements for operating the chamber consists of fluidic elements which are mechanical elements operated by air (oxygen) pressure. The control elements are housed in a control box. The only source of power is gas pressure. No electricity is utilized to power the various elements of the control box. While all the elements of the control box are catalogue items available on the market, these elements are interconnected in a unique way to provide the desired function. The chamber is constructed in two parts that are mated when the chamber is in operation. When the two parts are mated, one end of the chamber is closed and the other end contains an opening to receive the part of the body being treated. This open end contains a ring and sleeve assembly. The ring is nested in the opening and the sleeve is retained on a lip formed on the ring by means of a retaining ring. In order that the two parts of the chamber can be readily aligned when assembling the chamber, blocks are provided at one end of the top part and mating slots are provided at this end of the bottom part. Both the top part or head is provided with a gasket that forms an air tight lip seal when the chamber is assembled. A plurality of latches are provided to secure the two parts to each other. The control box is coupled to the chamber by means of a plurality of hoses. The hoses are coupled to fittings provided on the outside of the closed end of the chamber. The closed end of the chamber also includes a manual relief valve and automatic relief valve. Further, a humidifier is detachably secured to the closed end of the chamber. The control box is also coupled by means of a hose to the humidifier.

While the chamber of this invention in its preferred embodiment is designed for the medical treatment of certain parts of the body, such as legs, arms, hands, and feet, the chamber could be enlarged to accommodate all but the head of the person being treated.

BRIEF DESCRIPTION OF THE DRAWING

A complete understanding of the details of the invention can be obtained from the following detailed description when read in conjunction with the annexed drawing in which:

FIG. 2 shows the preferred embodiment of FIG. 1 with various parts of the chamber separated;

FIG. 5(*a*) is a cross-section through the chamber with the upper and lower sections separated to show the details of the sealing gasket;

FIG. 5(*b*) is the same cross-section view as in FIG. 5(*a*) with the upper and lower section of the chamber mated.

DETAILED DESCRIPTION OF THE INVENTION

Figure 1:
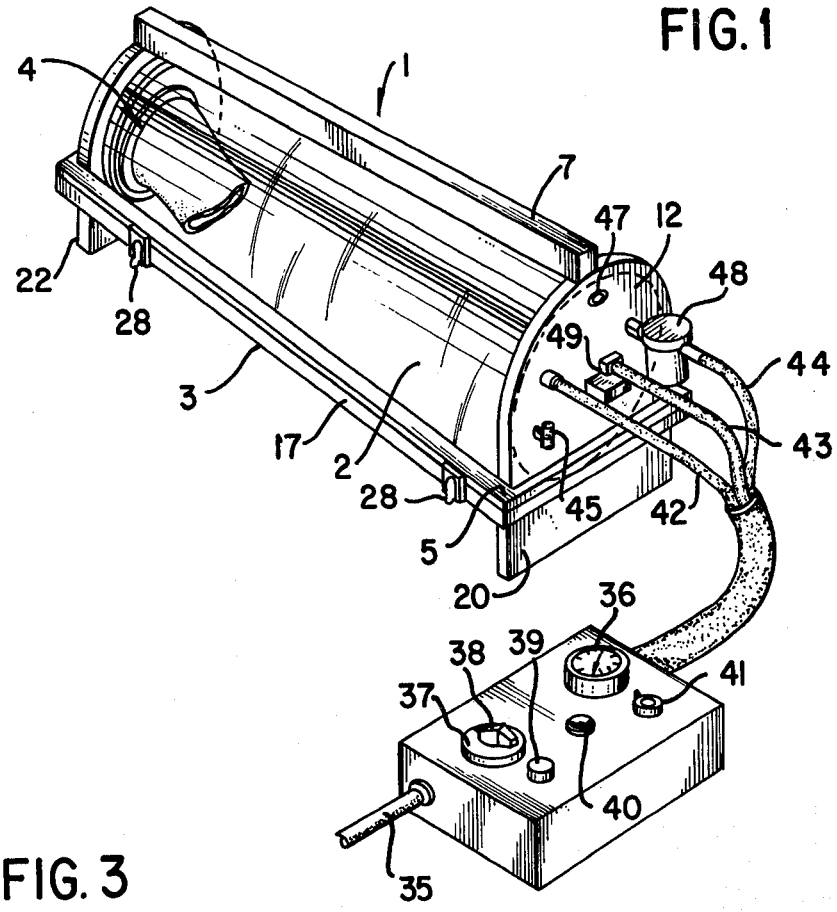
FIG. 1 is a perspective view of the preferred embodiment of the invention.

Referring to the drawing, FIG. 1 shows the apparatus of this invention in its assembled operative state while FIG. 2 shows the apparatus with the three basic components of the chamber 1 separated. As shown in FIGS. 1 and 2, the apparatus of this invention comprises chamber 1 having an upper section 2, a lower section 3 and a ring 4. Upper section or hood 2 is generally semi-cylindrical shaped. The bars 5, 6, 7 and 8 and the short bars 9 and 10 of hood 2 are made of aluminum and the balance of hood 2 is made of a drape molded transparent polycarbonate (LEXAN). The end 12 of hood 2 is closed by a sheet of the transparent polycarbonate. The end 14 is open to accommodate the ring 4 as shown in FIG. 1. The lower section or base 3 comprises a generally semi-cylindrical area 16 made of the transparent polycarbonate. The aluminum bars 17 and 18 are secured to area 16 in the position shown in FIG. 2. An aluminum bar 19 is secured along the bottom of area 16. One end of area 16 is closed by means of the rectangular sheet 20 made of the transparent polycarbonate. An aluminum bar 21 is secured along the top edge of sheet 20. A sheet 22 of the transparent polycarbonate is secured to the other end of area 16. Sheet 22 is formed such that it has a semicircular area 23 to accommodate ring 4, short straight upper edges extending beyond the semicircular area, two straight sides and a straight bottom edge. The short aluminum bars 60 and 61 are secured to a different one of the short upper edges of sheet 22. A slot 26 is provided adjacent each end of aluminum bar 21. The blocks 27 are secured adjacent each end to aluminum bar 8 of hood 2. The blocks 27 mate with the respective slots 26 when hood 2 is secured to base 3. Blocks 27 and slots 26 insure that the hood and bar are properly aligned. Hood 2 is secured to base 3 by means of a simple latch arrangement. A pair of latches or arms 28 are secured to bar 17 of base 3 as shown. An identical pair of latches 28 or arms are secured to bar 18 as shown. A pair of keepers 29 are secured to aluminum bar 5 of hood 2 and an identical pair of keepers 29 are secured to bar 6 of hood 2. In FIG. 2 only one keeper is visible on each bar 5 and 6. The latches or arms 28 are latched or locked on to their respective keepers 29 to secure hood 2 to base 3. A gasket to be described later with reference to FIGS. 5(*a*) and 5(*b*) insures that an air tight seal is formed when hood 2 is secured to base 3.

Figure 3:
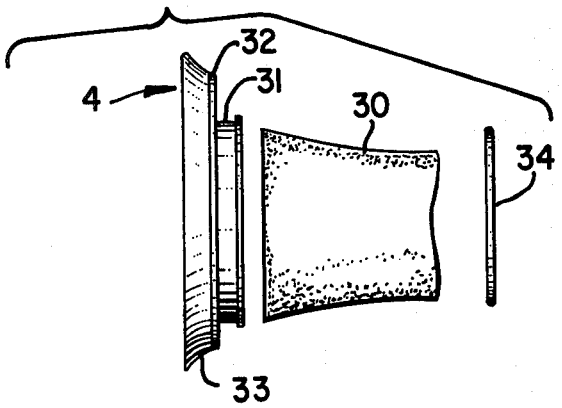
FIG. 3 shows the ring and sleeve arrangement of the preferred embodiment with the sleeve separated from the ring.
Figure 4:
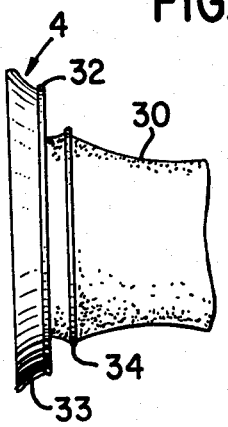
FIG. 4 shows the ring and sleeve of FIG. 3 assembled.

FIGS. 3 and 4 show the details of ring 4 as the manner in which sleeve 30 is secured to ring 4. As shown in FIG. 3, ring 4 comprises a first rim or ring 31 and a second rim or ring 32 that is larger in diameter than ring 31. As shown in FIGS. 1 and 2, rings 31 and 32 are joined by a ring shaped piece 34 made from the transparent polycarbonate. Note that ring 31 is not concentric with ring 32. A tapered gasket 33 is secured to ring 32. Sleeve 30 is a tapered cylindrical latex sleeve. As shown in FIG. 4, the large end of sleeve 30 is slipped over ring 31 and is secured to ring 31 by means of the hoop 34 which slips over sleeve 30 and press fits sleeve 30 onto ring 31.

When chamber 1 is assembled for operation, sleeve 30 is secured to ring 4 in the manner shown in FIGS. 3 and 4. Sleeve 30 is then slipped over the limb of the patient to be treated. Sleeve 30 comes in various different sizes so that the sleeve will properly fit the arm or leg of the patient being treated. After the sleeve is slipped over the limb that is to be treated, the limb is placed in base 3 with ring 4 properly positioned in the semicircular area 23 of base 3. Hood 2 is then secured to base 3 by properly placing the semicircular end 14 of hood 2 over ring 4 and then lowering end 12 onto base 3 such that pins 27 mate with the holes 26. Latches 28 are then latched onto keepers 29. The gasket 33 forms a seal when chamber 1 is assembled such that an air tight seal is formed around ring 4.

Figure 6:
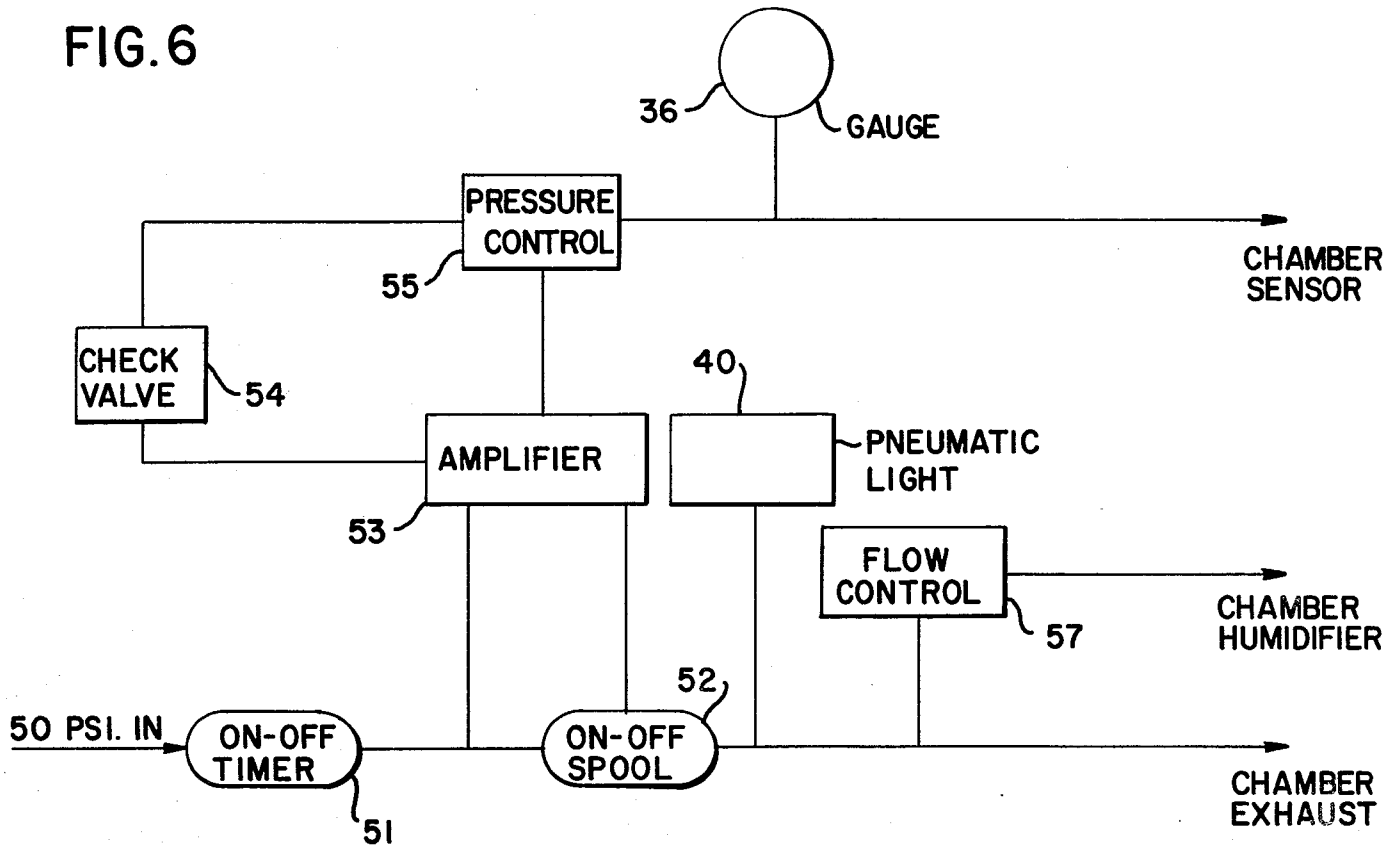
FIG. 6 is a schematic representation of the elements of the control box of the invention.

Referring again to FIGS. 1 and 2, control box 35 is generally rectangular shaped and houses the control elements shown in detail in FIG. 6. As shown more clearly in FIG. 2, the face plate or control panel of control box 35 includes a chamber pressure gauge 36, the timer dial 37 having an on-off timer setting knob 38, a cap 39 that covers a timing cycle control screw, an air lite 40, and a pressure adjusting knob 41.

Control box 35 is coupled to end 12 of hood 2 by means of the tubes 42, 43 and 44. These tubes for convenience are formed as a nest of tubes but can be three separate tubes. A manual exhaust valve 45 and an automatic relief valve 47 are secured to end 12 of hood 2. Tube 42 serves as a pressure sensing tube and is coupled to conventional quick connect and disconnect coupler secured in end 12 (this coupler is not visible in any of the figures. Tube 43 supplies oxygen power to the automatic exhaust valve 49. Automatic exhaust valve 49 is secured to end 12 of hood 2 and includes a conventional quick connect and disconnect coupler (not visible) to which tube 43 is coupled. A humidifier cup 48 is secured to end 12 and communicates with the inside of chamber 1. Tube 44 is coupled to humidifier cup 48 and provides oxygen to chamber 1 through humidifier cup 48. Again humidifier cup 48 is provided with a quick connect and disconnect coupler (not visible) to which base 44 is coupled. All the tubes or base couplers on end 12 may be any conventional couplers and the ends of tubes 42, 43 and 44 have couplers that mate with these conventional couplers. Therefore, the couplers on humidifier 48, the coupler on automatic exhaust valve 47 and the coupler to which tube 42 is coupled are not shown in any of the figures. Control box 35 is provided with a source of oxygen (not shown) by means of the tube 50. The free end of tube 50 is connected to a source of oxygen (an oxygen tank for example) that supplies oxygen to control box 35 at a pressure of approximately 50 PSI.

Referring now to FIG. 6, the figure is a schematic of the fluidic elements that make up control box 35. As shown in FIG. 6, these elements include an on-off timer 51, and on-off spool 52, an amplifier 53, a check valve 54, a pressure control device 55, gauge 36, the pneumatic light 40 and flow control device 57 all interconnected as shown in FIG. 6. Oxygen via tube 50 is coupled to on-off timer 51. The output from pressure control device 55 is coupled to tube 42, the output of on-off spool 52 is coupled to tube 43 and the output of flow control device 57 is coupled to hose 44. All the elements shown in FIG. 6 are conventional fluidic elements that are available on the market and are in fact purchased from manufacturers of such devices.

Referring now to FIGS. 5(*a*) and 5(*b*), these figures show the details of the sealing gasket 58. Sealing gasket 58 is embedded in bottom surface of aluminum bars 5, 6, 8, 9 and 10 of hood 2 in the manner shown in FIGS. 5(*a*) and 5(*b*). In FIG. 5(*a*) hood 2 and base 3 are slightly separated and in FIG. 5(*b*) hood 2 and base 3 mated in their operative state. Gasket 58 has a lip 59 which extends downward toward base 3. When hood 2 and base 3 are joined, lip 59 overlaps the adjacent aluminum bars of base 3 such that as the pressure increases in chamber 1, lip 59 is pressed more tightly against the aluminum bars of base 3 to form an air tight seal.

In operation, sleeve 30 is placed around the limb to be treated, the limb and ring 4 are then placed in base 3 and hood 2 is secured to base 3 by means of the latches 28 and keepers 29. Of course, ring 4 is properly sealed in base 3 and hood 2 and blocks 27 are positioned in holes 26. Distilled water is placed in humidifier cup 48 and the controls on control box 35 are set. Timer knob 38 is set for the total time that the patient is receiving treatment. Cap 39 is removed and the cycle time screw is adjusted if necessary. Pressure knob 41 is set to the desired pressure which is read on gauge 36. Humidified oxygen at a pressure of 50 PSI but at a slow rate of 10 liters per minute is applied to chamber 1 through humidifer cup 48. The oxygen flow is stopped when the pressure in chamber 1 reaches a pre-set level (usually 50 mm Hg or 0.9 PSI). The flow of oxygen is stopped by means of spool 52. Stopping flow by means of spool 52 stops the increase in pressure in chamber 1 and operates exhaust valve 46, thereby reversing the pressure in chamber 1 to atmospheric. This cycle is then continuously repeated for the time period set by on-off timer 51. When oxygen is supplied to chamber 1, air light 40 emits one color light and when the chamber is being exhausted, air light 40 emits another color. In this way, the attendant can at a glance determine that the unit is cycling properly. Further, as has been previously mentioned, all the elements of control box 35 are fluidic elements controlled by the oxygen sources or other gas sources if a source other than oxygen is used. Thus, no electricity is used with the apparatus of this invention. This, of course, provides a safety measure since any sparking of elements powered by electricity in the presence of oxygen could be dangerous.

Chamber 1 as shown in the drawing is designed to accommodate a person's arm up to just above the elbow or a leg just above the knee. An entire arm or leg can be housed inside chamber 1 by merely making base 3 and hood 2 longer. Further, an entire body, other than the head, could be treated inside chamber 1 by making chamber 1 large enough to house the entire body. In addition, the latch and keeper arrangement can be modified by having two latches at each end and one latch on each side for a total of six latches. Further, it will be obvious to those skilled in the art that various changes can be made to the embodiment shown and described without departing from the spirit and scope of the invention as defined in the claims.

What is claimed is:

1. A low pressure hyperbaric device for treatment of a patient comprising a two part chamber, means for holding the two parts in assembled and sealed condition, the chamber having an entrance adapted to allow the introduction of a body part, means associated with the entrance to seal the body part to thereby provide an air tight chamber, a pressured source of gas and means for cyclically pressurizing the hyperbaric chamber with gas and exhausting the hyperbaric chamber said means including:

timing means connected in series with the pressurized source of gas for controlling on-off gas flow for the overall treatment time, valve means connected to the flow from the timing means, said valve means being moveable to the moveable position upon receiving the gas flow from the timing means, a flow control means connected on its inlet side to the valve means and to the hyperbaric chamber on its outlet side, said flow control means controlling flow into the hyperbaric chamber, an exhaust valve in fluid communication with the chamber, a second flow line extending from the valve means to the exhaust valve for the hyperbaric chamber, pressure control means having an inlet in communication with the pressure in the hyperbaric chamber and an outlet in communication with the valve means whereby when the prescribed pressure is reached within the hyperbaric chamber the pressure control means closes the valve means thereby releasing the exhaust valve so that the hyperbaric chamber pressure will be exhausted and whereby upon the return of the chamber to ambient pressure the valve means is returned to open position for a new cycle.

2. The invention as set forth in claim 1 and wherein the means for holding the two chamber parts in assembled and sealed condition comprises latch means for holding the two parts in assembled position and a sealing gasket to maintain this sealed condition.

3. A device for cyclically pressurizing and exhausting a chamber with a gas including a source of a pressurized gas said device comprising:

timing means connected in series with the pressurized source of gas for controlling on-off gas flow for the overall treatment time, said timing means including an on-off valve for starting and stopping flow, valve means connected to the flow from the timing means, said valve means being moveable to the on position upon receiving the gas flow from the timing means, a flow control means connected on its inlet side to the valve means and to the chamber on its outlet side, said flow control means controlling flow into the chamber, an exhaust valve in fluid communication with the chamber, a second flow line extending from the valve means to the exhaust valve for the chamber, pressure control means having an inlet in communication with the pressure in the chamber and an outlet in communication with the valve means whereby when the prescribed pressure is reached within the chamber the pressure control means closes the valve means thereby releasing the exhaust valve so that the chamber pressure will be exhausted and whereby upon the return of the chamber to ambient pressure the valve means is returned to open position for a new cycle.

* * * * *